United States Patent [19]

Forrest

[11] Patent Number: 4,550,801

[45] Date of Patent: Nov. 5, 1985

[54] PERSONAL HIGH RISE EVACUATION APPARATUS

[75] Inventor: William E. Forrest, Denver, Colo.

[73] Assignee: Advanced Evacuation Systems, Denver, Colo.

[21] Appl. No.: 676,386

[22] Filed: Nov. 29, 1984

[51] Int. Cl.[4] ..... A62B 1/14; A62B 1/20

[52] U.S. Cl. ..... 182/7; 182/191

[58] Field of Search ..... 182/5, 6, 7, 191, 192, 182/193; 188/65.2, 65.4, 65.5, 65.1

[56] References Cited

U.S. PATENT DOCUMENTS

| | | | |
|---|---|---|---|
| 386,237 | 7/1888 | Budd | 188/65.4 |
| 720,310 | 2/1903 | Baumgartner | 188/65.5 |
| 771,251 | 10/1904 | Howe | 188/65.4 |
| 1,103,849 | 7/1914 | Stenborg | 182/5 |
| 1,187,754 | 6/1916 | Lyra | 188/65.5 |
| 1,351,734 | 9/1920 | Barrington | 182/5 |
| 3,197,204 | 7/1965 | Holkesvick | 188/65.4 |
| 3,250,515 | 5/1966 | Hudnall | 188/65.4 |
| 4,311,217 | 1/1982 | Wood | 182/5 |
| 4,508,193 | 4/1985 | Forrest | 182/5 |

*Primary Examiner*—Reinaldo P. Machado
*Attorney, Agent, or Firm*—Edwin L. Spangler, Jr.

[57] ABSTRACT

This invention relates to an improved apparatus for one person to use in effecting an escape from a tall building or the like under emergency conditions, such apparatus including a novel load-lowering device in the form of a small cylindrical drum having generally teardrop-shaped apertured endplates on both ends thereof and an eye projecting therebeneath for attachment of a load-carrying sling. The elongate portions of the teardrop-shaped endplates are vertically aligned and project beyond the surface of the drum, such projections containing the apertures. A rope is threaded onto the load-lowering device by first being passed up and in through the aperture in the lower endplate, then wrapped three or four turns around the drum before finally being passed up and out through the aperture in the upper one or vice versa. The aperture in the upper endplate is essentially circular and sized to loosely receive the rope while the one in the lower endplate includes a similarly shaped portion merged on at least one side with a tapered slot having a width at the entrance thereto approximating the thickness of the rope and tapering to a relatively narrower dimension near its remote or blind end, such slot cooperating with the turns of rope wrapped in the proper direction around the drum to define a self-actuating brake automatically operative under load to control continued downward movement of the latter to a preselected safe rate when the end of the rope hanging beneath the load-lowering device is released and allowed to run free. In the manually-controlled descent mode as opposed to the previously-described self-braked mode, the operator need only grasp and move the free-hanging untensioned end of the rope along the tapered slot to vary the rate of descent or stop it altogether by tensioning and holding it into the blind end where it is the narrowest.

10 Claims, 5 Drawing Figures

PERSONAL HIGH RISE EVACUATION APPARATUS

In my earlier U.S. patent application Ser. No. 582,266, filed Feb. 22, 1984, now U.S. Pat. No. 4,508,193, I disclosed a personal descent control device which required that the user wrap the rope around the friction drum preparatory to making a descent. Also, the unit included no self-actuating brake, but instead, placed both the control of the descent mode and the braking mode under the manual control of the user.

Now, such a unit is well suited to the needs of a skilled operator like, for example, a fireman who is used to operating at considerable heights above the ground and under emergency evacuation conditions. Moreover, it possessed a distinct advantage over the descent control device forming the subject matter of the present application in that it could be attached to an intermediate point on the rope without having access to either end. This feature is of special importance to the trained firefighter who must, on occasion, fasten the device onto the rope at an intermediate point when access to the secured upper end of the rope is unavailable. If, for instance, the rope has already been used by a person on an upper floor to effect an escape and the firefighter or other person on a lower floor is denied access to the point of attachment because of the fire, then it becomes imperative that the second or subsequent user be able to hook on where he or she is at the time. The skill, knowledge and presence of mind necessary to accomplish such an operation under emergency conditions is probably beyond that of the ordinary user, therefore, there remains a need for a foolproof personal descent control device which requires no threading of the rope or other skilled manipulation. Also, a device of this type designed primarily for use by unskilled operators should, if possible, include a "fail-safe" mode wherein if, perchance, the user should faint or become otherwise incapacitated under the stress of the moment, it will become automatically operative to take over and let the person continue on down at a safe, predetermined well-controlled rate of descent. Perhaps the best of all solutions would be a unit that could be prethreaded for the unskilled and yet opened up for use by the skilled operator to enable him or her to have the option of connecting onto the descent rope intermediate its ends.

I have now discovered that both of these objectives can, indeed, be achieved. For the unskilled user, first of all, I would provide a version of the descent control device having closed apertures in both its top and bottom endplates which would require that the rope be prethreaded therethrough thus making the unit instantly deployable without the user having to do more than open an escape route and anchor the upper end of the rope to a suitable heavy object or other available point of attachment. Using the foregoing preloaded approach, the possibility of the descent control device becoming separated from the rope is virtually non-existent since, to do so, requires a conscious manipulation on the part of the operator. This, by itself, is not unique since others before me have designed preloaded systems involving a friction drum like, for example, that shown in the U.S. Pat. No. 1,351,734 issued many years ago to Barrington and the system developed by Wood shown in his late U.S. Pat. No. 4,311,217, both of which were mentioned in my earlier patent referred to above. Stenborg in his Pat. No. 1,103,849 shows a preloaded descent control device also; however, it is quite different in operation in the lays or turns of the rope lying next to one another are not in frictional contact. The other patents listed in my earlier patent are of but general interest in that they either are not preloaded or else operate upon somewhat different principles. The significance of these prior art descent control devices, or the lack thereof depending upon one's point of view, is the fact that none of them includes a fail-safe feature by means of which the descent of the user is automatically controlled at a predetermined safe rate whenever he or she ceases to exercise manual control, whether voluntarily or involuntarily. The eighty-plus year old patent to Wyss-Baumgartner No. 720,310 probably comes as close as any known to me as far as having a self-actuating brake feature in that when the user releases his or her hold upon the handles "e", the coils "b" could, conceivably, grip the wire "a" and thus automatically halt the descent. On the other hand, it is doubtful that unit is, in fact, self-braked since evidently manual actuation is required to brake the descent. However Wyss-Baumgartner's system works, it is not of any particular importance since the automatic braking system I have devised is quite different and, insofar as I am aware, unique.

For the skilled user, on the other hand, I have developed a gated version of the unit designed to be preloaded which preserves that option of being able to connect onto the line intermediate its ends as was true of my previously-patented descent control device. The latter unit, while just slightly more complicated, is, nevertheless, more versatile and better suited to use by firemen, window washers and others used to working in high places that need the versatility of being able to hook onto the rope anywhere, not just at an end.

I have now discovered in accordance with the teaching of the instant invention that a preloaded or gated friction-drum type descent control device can, in fact, be made that incorporates a self-actuating braking system based upon the principle of releasing manual control over the free or loose-hanging untethered end of the rope and allowing it to enter a tapered slot within which it will be gripped to the point where slippage at a predetermined controlled rate takes over and remains effective until the user or some third person resumes manual control of the system and lifts or otherwise moves the aforementioned loose lower end of the rope to some other position within the tapered slot where the descent proceeds at a slower or a faster rate or stops altogether.

It is, therefore, the principal object of the present invention to provide a novel preloaded or gated personal descent control device for use in escaping from burning buildings and the like.

A second objective is the provision of a device of the character described which includes a self-actuating braking system which becomes automatically operative to control the descent of the load to a predetermined safe rate whenever manual control of the system is relinquished and it is loaded.

Another object is the provision of a friction drum type escape device for use with a rope that includes a manual cleat-forming tie-off in addition to the self-actuating brake.

Still another objective of the within-described invention is the provision of single-acting but doubled-up self-actuating braking system that is fully operative and automatically so regardless of whether the rope is wound around the drum clockwise or counterclockwise.

An additional object of the invention is to provide a friction drum type load-lowering device in which the load is suspended from the axis of the drum thus maintaining the latter in a substantially vertical position when under load.

Further objects are to provide a manually-controllable load-lowering device which is extremely simple, lightweight, compact, rugged, easy to use, reliable, practically foolproof, safe, versatile in that it can handle persons of various sizes and bodyweights without adjusting its preloaded condition, and one that is even decorative in appearance.

Other objects will be in part apparent and in part pointed out specifically hereinafter in connection with the description of the drawings that follows and in which.

Figure 1:
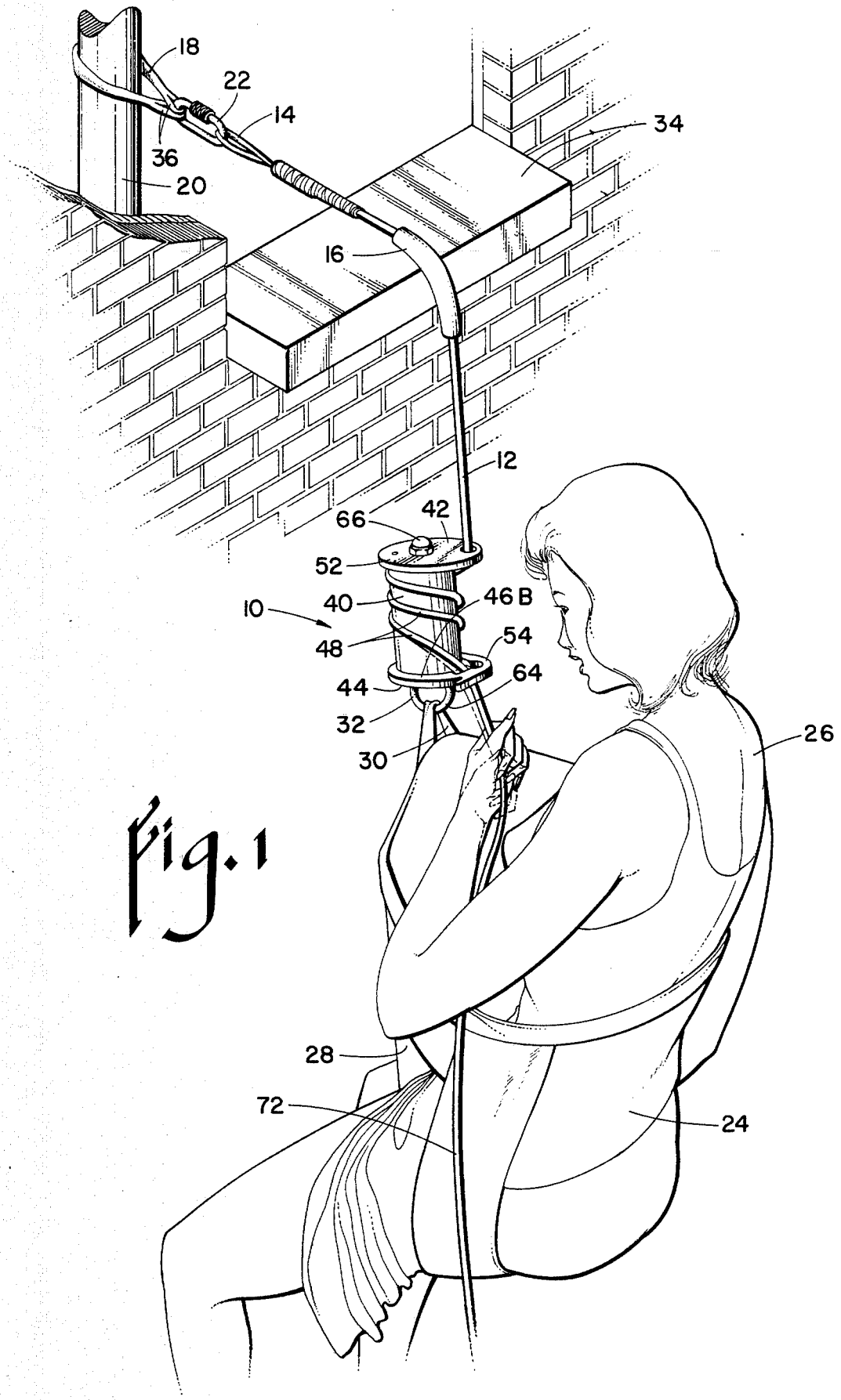
FIG. 1 is a perspective view showing a substantially oversized version of the preloaded embodiment of the descent control device anchored in place inside a building adjacent a window with a user suspended therebeneath in a body pouch about to descend down an outside wall.

Referring next to the drawings for a detailed description of the present invention and, more particularly, to FIG. 1 for this purpose, reference numeral 10 has been chosen to broadly identify the personal descent control device which will be seen to comprise a part of an escape assembly which in the particular form shown includes a fire-resistant rope 12 with an eye 14 spliced into one end, a rope guard 16, a web sling 18 for anchoring the upper end of the rope to a suitable anchor 20, a conventional carabineer 22 for fastening the eyesplice to the sling, and a body pouch 24 for the escapee 26 to sit in during the descent. Pouch 24, in the particular form shown, is similar to that which forms the subject matter of my copending U.S. Design patent application Ser. No. D-582,269,. Other types of body harnesses, slings and the like can, of course, be substituted for the one shown; however, it does have the advantage of simplicity and universality in that it will fit anyone from a small child to a large adult and hold them securely even though they lose consciousness during the descent. Moreover, there are no straps to adjust, buckles to fasten or other manipulations to be carried out other than to step into and through the leg-receiving openings 28. The assembly as shown reveals the support loop 30 located at the front upper edge of the pouch sewn directly through the eye in eyebolt 32 in the bottom of the descent control fixture so that the user does not have to do this himself or herself. Of course, in the modified gated version shown in FIGS. 4 and 5 which is intended for use by firemen and other skilled persons accustomed to working in high places, the pouch would not generally be sewn more or less permanently to the descent fixture 10 but, instead, a second carabineer (not shown) would be used to make a detachable connection.

Rope 12, as was the case in my previously patented version of the descent control fixture is preferably made of the synthetic fiber sold under the trademark "Kevlar" because of its well known fire-resistant properties coupled with its tremendous strength. For instance, as was the case before, a rope of 3/16 inchcs in diameter can easily support loads well in excess of what any single person would weigh with a large safety factor. A Kevlar rope long enough to reach the ground from a thirty story building, for example, weighs only a few pounds and can be coiled in a sack or pouch small enough to fit easily into one side of a briefcase. As before, precautions must be taken to not bend it sharply because to do so greatly reduces its load-carrying capacity. If, however, an eye 14 is spliced onto the end thereof as shown, then this problem is avoided. Sleeve 16 merely protects the rope against abrasion from the window sill 34.

Web sling 18 is, once again, intended as being representative of one of identical design, but much longer, that would more likely be included as a part of the assembly in order to accommodate a wider variety of potential anchor points like, for example, a dresser, desk or other large piece of furniture. It has loops 36 sewn in both ends and brought together on opposite sides of the anchor 20 to receive the carabineer. Anchor 20 might be a steam pipe or the like, however, more likely it would be a large piece of furniture inside the room.

Figure 2:
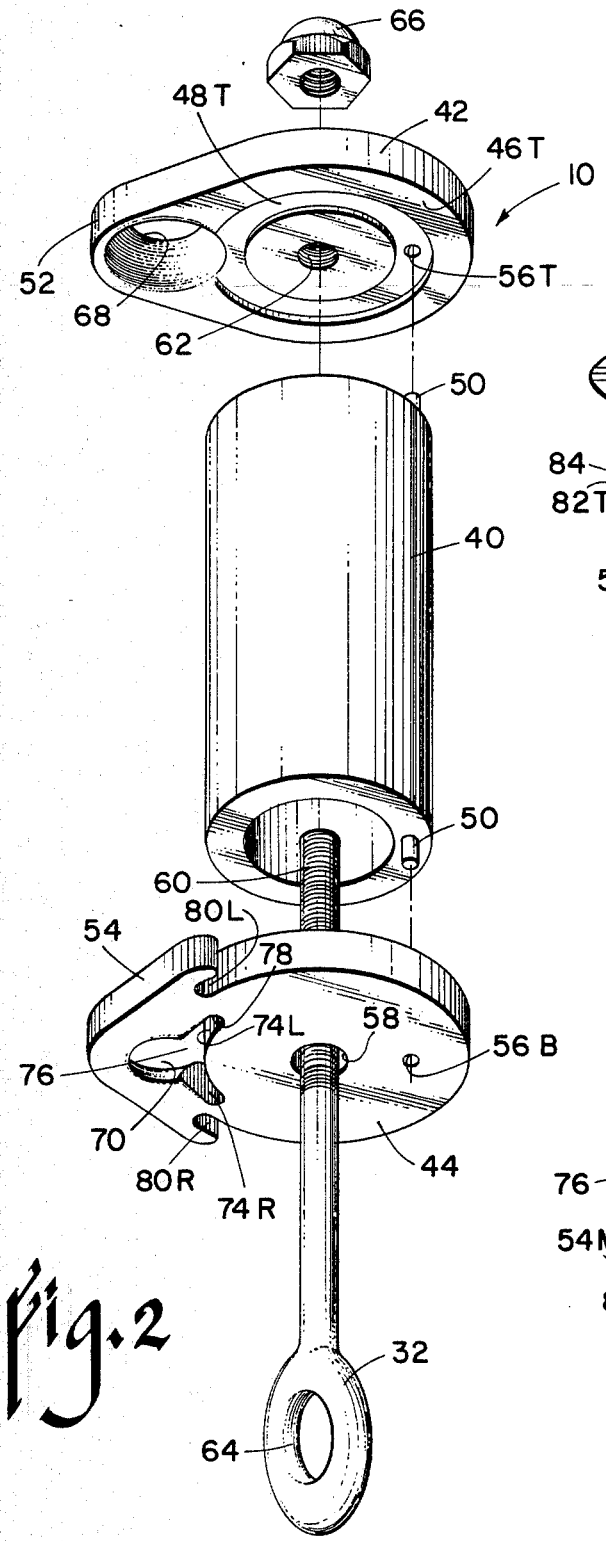
FIG. 2 is an exploded perspective view to a greatly enlarged scale showing the preloaded embodiment approximately actual size.

The descent control fixture which, for illustrative purposes has been shown greatly oversized in FIG. 1 and very nearly actual size in FIG. 2 will be seen to include a hollow cylindrical drum 40 capped on both ends by upper and lower endplates 42 and 44, respectively. Both of these endplates are generally teardrop-shaped and slightly larger in diameter than the cylindrical sleeve forming drum 40 thus defining marginal flanges 46T and 46B bordering the latter and functioning as a stop to maintain the coils 48 of the rope 12 in place thereon as shown. These same endplates both include, in the particular form illustrated, an annular groove 48T (FIG. 2) and 48B (FIG. 5) into which the drum-forming sleeve ends fit and are recessed. Since it is preferable that the projecting apertured portions 52 and 54, respectively, of the endplates 42 and 44 lie in substantial vertical alignment with one another, alignment pin 50 projecting beyond both ends of the drum enters suitably placed holes 56T and 56B in the upper and lower endplates for the purpose of maintaining this relationship. Lower or bottom endplate 44 is centrally apertured as shown at 58 to loosely receive the threaded shank 60 of eyebolt 32. Internally-threaded aperture 62 in the top endplate 42 receives the threaded eyebolt shank 60 and holds the fixture 10 in assembled relation with the top of the eye 64 defining a stop on the lower end of the assembly. In the preferred embodiment shown, a cap-nut 66 screws onto the end of the eyebolt shank projecting above the top endplate thus assuring that the assembly stays together.

Rope 12, in the preloaded embodiment of FIGS. 1 and 2 is first threaded up through aperture 70 in projecting apertured portion 54 of the lower endplate 44 preparatory to being wrapped three or four turns around the drum 40 before passing up and out through oversize aperture 68 in the corresponding apertured portion 52 of the upper one 42. Thus, with body pouch 24 more or less permanently connected to the lower end of the fixture 10, the only way it can be unthreaded is to pull eyesplice 14 back through endplate openings 68 and 70 which cannot, for all practical purposes, happen accidentally, only intentionally. As previously mentioned, upper aperture 68 is oversized with respect to the rope 12 which slips easily through it as the escapee makes his or her descent. The underside of opening 68 as well as the top of opening 70 in the bottom endplate 44 are smoothed and rounded to prevent abraiding or otherwise damaging the rope. The friction developed between the surface of drum 40 and the several turns 48 of the rope wrapped therearound is sufficient to slow the descent of the escapee 26 to a predetermined safe controlled rate of at most a couple of feet per second provided the user has released his or her hold upon the trailing free end 72 of the rope and allowed it to run free and seek a position somewhere along the tapered slot 74R or 74L as shown in full lines in FIG. 1. The term "predetermined" as used herein is not intended to mean "constant" since the rate of descent will obviously vary somewhat with the load. Instead, the term is used to define a *safe* rate of descent regardless of the load whether it be a child weighing 50 pounds or a fireman carrying an adult to safety with the two having combined weights in excess of 400 pounds. If, therefore, this predetermined safe rate of descent appears to be too slow, the escapee need only move the rope into a wider portion of the slot. It should, perhaps, be mentioned that even if the rope is held in the center of opening 70 and outside slot 74 altogether, the friction developed as the rope slips around the drum will be effective by itself to slow the descent to a rate which will not result in injury. It is the latter feature which makes the instant escape device unique and which will be explained in detail in connection with FIG. 2.

Slots 74 both open into aperture 70 on opposite sides of the latter and they follow the curvature of the outer cylindrical surface of drum 40 in essentially circumferential relation thereto. With the rope wound clockwise around the drum as viewed from above and as seen in FIG. 1, its tendency will be to enter the lefthand slot 74L as it is pulled to the left forming the lowermost coil thus assuming the phantom-line position. The entryway 76 into the slots 74 is sized to approximately the diameter of the rope 12; however, it tapers from there all the way to the blind end 78 thereof which is much narrower than the rope is thick. Slots 74, being thus gradually tapered, they enable the user to manually control his or her rate of descent rate simply moving the rope to selected positions along the slot. Slots 74, therefore, constitute a self-braking feature which will automatically actuate to slow the descent of the escapee to a predetermined controlled rate should he or she let go of the trailing end 72 of the rope. On the other hand, if the user wishes to go faster, he or she need only manually shift the rope to a wider section of the slot. Stopping the descent altogether is accomplished by pulling upon the free end of the rope and holding it against the blind end of the slot where it is the narrowest, the latter having been shown by phantom lines in FIG. 1. Note also, that a third person on the ground or elsewhere having acccss to the free end of the rope can, if necessary, further arrest or stop the descent with a gentle tug thereon.

Only one of the two slots is operative depending upon which direction, clockwise or counterclockwise, the rope is wrapped around the drum. It is preferred to provide both slots 74R and 74L even though the descent control device is preloaded on the rare chance that someone would unthread the unit and wrap it backwards in which event, with only a single slot, the self-actuating braking system would become inoperative.

Figure 3:
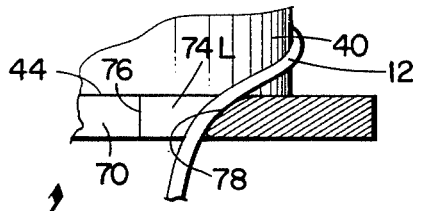
FIG. 3 is a fragmentary view to a further enlarged scale, partly in section and partly in elevation, showing the upwardly-rounded blind end of the slot.
Figure 4:
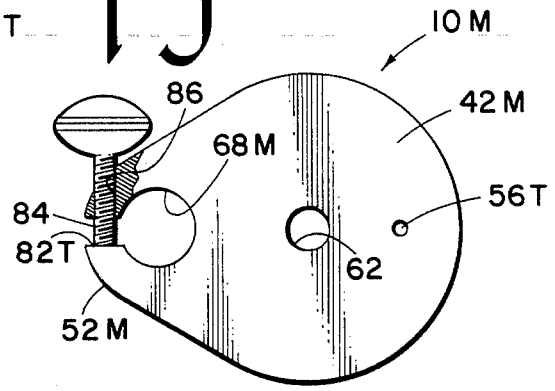
FIG. 4 is a top plan view to the same scale as FIG. 1 showing the top endplate of the gated version specifically adapted for use by the more skilled person, portions having been broken away and shown in section to better reveal the internal construction; and, FIG. 5 is a top plan view of the bottom endplate of the gated version.
Figure 5:
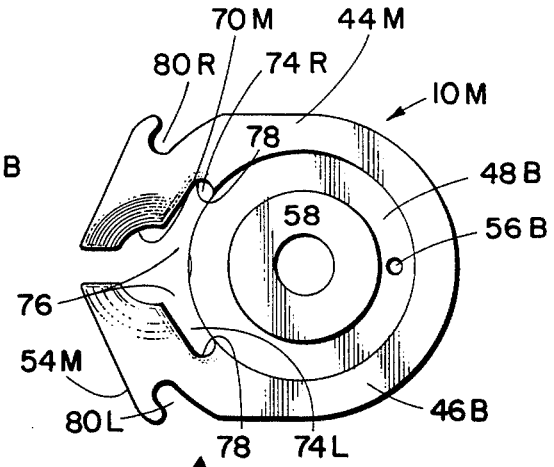

With brief reference to FIGS. 3 and 4 it will be seen that the upper side margins of the slots are rounded as indicated by the rendering in FIG. 5 and, more important, the blind ends thereof 78 are generously radiused such that the rope curves upwardly therearound and moves onto the drum at an angle closely approximating that at which it winds onto the lowermost coil as seen most clearly in FIG. 3.

FIGS. 2 and 5 also show that the projecting end portion 54 of the bottom endplate is also provided with a pair of oppositely-opening slots 80R and 80L. When and if used, both of these slots are necessary and they cooperate to define a cleat around which the free-hanging end of the rope may be wrapped and tied off. Actually, this is nothing more than an additional braking feature which supplements that of the self-actuating one defined by holding the trailing end of the rope in the blind end 78 of the slots 74 and, for this reason, may be eliminated altogether.

Finally, with respect to the gated embodiment 1OM of FIGS. 4 and 5, the slightly modified top endplate 42M will be seen to have a slot 82T sized to pass the rope 12 into aperture 68. This slot or entryway into the rope-receiving aperture is temporarily closed by gate 84 which, in the particular form shown, comprises nothing more than a thumbscrew screwed into axially-aligned internally-threaded holes 86 intersecting slot 82 and extending across the projecting portion 52M. Thumbscrew is intended as being representative of various gate-forming devices such as, for example, spring-loaded pins and other similar subassemblies of the general type well known in the art that would suffice to close off the entryway into aperture 68 and secure the rope therein.

Bottom modified endplate 44M is identical to the one 44 shown in use on the preloaded version except that it has the slot 82B opening into its rope-receiving aperture 76. This slot does not have to be gated like the one above since, with gate 84 closed the rope cannot come off the device 10. This gated version 1OM has the advantage, primarily, of being attachable to the rope intermediate its ends which was not true of the preloaded one. Moreover, the skilled user could, if the occasion demanded such as carrying a second person down to safety, wrap an extra turn or two around the drum to accommodate the extra load.

What is claimed is:

1. A descent control device for use with a load-carrying harness suspended therefrom to lower a load down on a rope from an elevated position where one end is anchored to a relatively lower position reached by its free end which comprises: a friction drum of a length adapted to receive a plurality of turns of rope wrapped therearound, said drum having an upper end and a lower end; top and bottom endplates attached respectively to the upper and lower ends of said drum, said endplates both having a portion thereof overhanging said drum, each of said overhanging portions containing an aperture therethrough sized to loosely receive the rope, the aperture in the bottom plate including at least one arcuate slot with an entryway of a width adapted to freely admit the rope opening into the latter, said slot tapering from said entryway as it follows the contour of the drum part way therearound to a relatively narrower blind end; and means depending from the bottom plate for attaching the load-carrying harness, said drum with several turns of the rope coiled upwardly therearound in the direction of the slot cooperating therewith and with the aperture in the top endplate when the free end of said rope is allowed to hang free and seek a position intermediate the entryway and blind end of said slot to slowly lower the load at a predetermined safe rate, said slot providing means for varying the descent rate by manually positioning the rope therealong, and said slot becoming operative as a manually-actuated brake when the free end of the rope is tensioned and held in the blind end thereof.

2. The descent control device as set forth in claim 1 in which: the aperture in the bottom plate includes two arcuate slots partially encircling the drum in opposite directions.

3. The descent control device as set forth in claim 1 in which: the upper and lower endplates are non-rotatably attached to the drum with their apertures in substantial vertical alignment with one another.

4. The descent control device as set forth in claim 1 in which: the underside of the upper endplate and the top of the bottom endplate bordering the rope-receiving apertures therein are smoothly rounded.

5. The descent control device as set forth in claim 1 in which: the blind end of the slot is upwardly curved in the direction of the lowermost coil of rope wound upon the drum.

6. The descent control device as set forth in claim 1 in which: the upper and lower endplates are generally teardrop-shaped and oversized with respect to the drum ends so as to cooperate therewith and with one another to define annular stop-forming flanges therearound effective to keep the coils of the rope in place.

7. The descent control device as set forth in claim 1 in which: the apertures in both the top and bottom plates are closed.

8. The descent control device as set forth in claim 1 in which: the overhanging portions of both the top and bottom endplates include other slots opening onto the periphery thereof and connecting into their respective rope-receiving apertures sized to admit an intermediate section of the rope into the latter.

9. The descent control device as set forth in claim 1 in which: the bottom endplate includes a pair of notches opening opposite one another adjacent the overhanging portion, said notches cooperating to define a cleat effective to receive a turn of the free end of the rope wrapped around said overhanging portion for tying-off the latter and stopping the descent.

10. The descent control device as set forth in claim 8 in which: gate-forming means bridges the notch in the overhanging portion of the top endplate, said gate-forming means having an open position effective to admit an intermediate section of the rope into the rope-receiving aperture and a closed position operative to trap said rope inside the latter.

* * * * *